US009931580B2

(12) United States Patent
Rehkemper et al.

(10) Patent No.: US 9,931,580 B2
(45) **Date of Patent: *Apr. 3, 2018**

(54) TOY VEHICLE WITH ROLLOVER STUNT MOVEMENTS

(71) Applicant: Rehco, LLC, Chicago, IL (US)

(72) Inventors: Steven Rehkemper, Chicago, IL (US); Jeffrey Rehkemper, Chicago, IL (US); Jeremy Posner, Chicago, IL (US)

(73) Assignee: Rehco, LLC, Chicago, IL (US)

( * ) Notice: Subject to any disclaimer, the term of this patent is extended or adjusted under 35 U.S.C. 154(b) by 186 days.

This patent is subject to a terminal disclaimer.

(21) Appl. No.: 14/800,842

(22) Filed: Jul. 16, 2015

(65) Prior Publication Data

US 2015/0314206 A1 Nov. 5, 2015

Related U.S. Application Data

(62) Division of application No. 13/597,443, filed on Aug. 29, 2012, now Pat. No. 9,352,242.

(60) Provisional application No. 61/307,904, filed on Aug. 29, 2011.

(51) Int. Cl.

| | |
|---|---|
| ***A63H 30/04*** | (2006.01) |
| ***A63H 17/00*** | (2006.01) |
| ***A63H 17/26*** | (2006.01) |

(52) U.S. Cl.

CPC ..... *A63H 30/04* (2013.01); *A63H 17/004* (2013.01); *A63H 17/26* (2013.01)

(58) Field of Classification Search

CPC .... A63H 17/262; A63H 17/395; A63H 17/36; A63H 17/004; A63H 17/26; A63H 33/00; A63H 30/04; B60G 2300/20

See application file for complete search history.

(56) References Cited

U.S. PATENT DOCUMENTS

| | | | | |
|---|---|---|---|---|
| 4,385,466 | A | 5/1983 | ReVelle | |
| 5,609,510 | A * | 3/1997 | Stubenfoll | A63H 17/26 446/437 |
| 5,667,420 | A * | 9/1997 | Menow | A63H 17/004 180/22 |
| 5,727,985 | A | 3/1998 | George et al. | |
| 6,394,876 | B1 * | 5/2002 | Ishimoto | A63H 17/004 446/427 |
| 6,439,948 | B1 * | 8/2002 | Ostendorff | A63H 17/004 446/154 |

(Continued)

*Primary Examiner* — Melba Bumgarner
*Assistant Examiner* — Amir Klayman
(74) *Attorney, Agent, or Firm* — Adam K. Sacharoff; Much Shelist

(57) ABSTRACT

An illustrative toy vehicle is provided having a two-section chassis and a pivot mechanism rotatably attaching the two sections. The vehicle has the ability to move in multiple orientations and execute movements including a side rollover movement where the pivot mechanism assists in directing the vehicle to roll over from a first orientation to a second orientation about a central axis. A modified wheel design further assists in facilitating movements including the rollover movement. The vehicle may perform movements without user control where the vehicle responds to external factors, such as objects or terrain or the vehicle may use control systems such as radio or remote control with a transmitter/receiver pair, on vehicle switches or sensors utilizing interactive preprogrammed content.

14 Claims, 11 Drawing Sheets

(56) References Cited

U.S. PATENT DOCUMENTS

| | | | | |
|---|---|---|---|---|
| 6,589,098 | B2 | 7/2003 | Lee et al. | |
| 6,692,333 | B2 * | 2/2004 | Kislevitz | A63H 17/262 446/437 |
| 6,786,795 | B1 * | 9/2004 | Mullaney | A63H 17/05 446/431 |
| 7,494,398 | B2 * | 2/2009 | Laurienzo | A63H 17/008 446/454 |
| 2003/0082990 | A1 * | 5/2003 | Lynders | A63H 17/004 446/437 |
| 2004/0092208 | A1 | 5/2004 | Weiss et al. | |
| 2004/0198165 | A1 * | 10/2004 | Lee | A63H 17/00 446/427 |
| 2005/0148282 | A1 * | 7/2005 | Moll | A63H 17/00 446/456 |
| 2008/0318491 | A1 * | 12/2008 | Ishibashi | A63H 17/004 446/456 |
| 2009/0149113 | A1 | 6/2009 | Lund et al. | |

* cited by examiner 110
134
133
132
197
138
193

110
197
132
133
138
193

138
110
132
133
197

193
138
197
132
133
110

138
193
197
132
133
110

193
138
110
197
132
133

110
135
132
133
197
193

TOY VEHICLE WITH ROLLOVER STUNT MOVEMENTS

CROSS-REFERENCE TO RELATED APPLICATIONS

The present application claims priority to U.S. Provisional Application No. 61/528,430 filed on Aug. 29, 2011 entitled "Toy Vehicle with Rollover Stunt Movements" and to U.S. application Ser. No. 13/597,443 filed on Aug. 29, 2012 entitled "Toy Vehicle with Rollover Stunt Movements", now U.S. Pat. No. 9,352,242 B2, which issued on May 31, 2016; the disclosures of which are incorporated in their entirety by reference herein.

TECHNICAL FIELD

The illustrative embodiments relate to a vehicle with a two-section chassis, the ability to move in multiple orientations and execute movements including a side rollover movement where a pivot mechanism assists in directing the vehicle to roll over between a first orientation and a second orientation.

BACKGROUND

Remote control vehicles have long been known in the art and commonly used by children and adults for a variety of entertainment activities. Examples of vehicles include cars, trucks, aircraft, and watercraft. A continuing need exists for new performance features to add entertainment and play value to remote controlled vehicles.

SUMMARY

In one or more illustrative embodiments there may be provided a toy vehicle having a two section chassis including a first section and a second section pivotally attached to one another, the first section further defined as a leading section relative to the direction of vehicle movement, the second section further defined as a trailing section relative to the direction of vehicle movement; two sets of wheels, a first set and a second set rotatably attached to their respective sections where each wheel includes an edge and a height greater than the height of the two section chassis. The vehicle may further include a first orientation and a second orientation, the second orientation further defined as a vehicle orientation opposite the first orientation; a center of gravity defined by the vehicle and a power source in communication with a motorized capability to steer and direct vehicle movements; and the motorized capability to steer and direct vehicle movements in communication with at least one of the wheels and configured to drive the vehicle through movements including a rollover movement. The rollover movement is a movement where the vehicle rolls over between the orientations when the vehicle is at rollover speed and in a rollover alignment. During the rollover movement the vehicle may roll between the first orientation and the second orientation further defined to include the vehicle rolling over from the first orientation to the second orientation or the second orientation to the first orientation. The rollover speed is further defined as a speed at which friction between a surface and one of the leading section wheel edges creates a frictional pivot point when in the rollover alignment. The rollover alignment is further defined as an angled pivotal alignment between the sections such that the vehicle's momentum at rollover speed and the center of gravity cause the vehicle to roll over about a central vehicle axis and over the frictional pivot point. The rollover movement may be triggered by a variety of occurrences such as when the vehicle is at rollover speed and an external force triggers the rollover alignment. The two sections may additionally have a bumper extending past the respective set of wheels.

In another illustrative embodiment there may be provided a toy vehicle having a two section chassis with a pivot mechanism rotatably attaching the two sections where the first section is further defined as a leading section relative to the direction of vehicle movement and the second section is further defined as a trailing section relative to the direction of movement. The vehicle may further include four wheels with a height greater than a height of the chassis and an edge; two of the four wheels are rotatably attached to the first section and the other two wheels are rotatably attached to the second section; a first orientation and a second orientation which is opposite the first orientation; and a center of gravity defined by the vehicle. The vehicle may also include a drive motor and a pivot motor, the drive motor in communication with at least one of the four wheels such that the drive motor is configured to drive forward and reverse movement of the vehicle and the pivot motor is in communication with the pivot mechanism such that the pivot motor is configured to drive rotation of the pivot mechanism. A control system with an integrated circuit and programmed software instructions may be included in the vehicle. The integrated circuit is in communication with the drive motor and pivot motor and the control system is configured to steer and direct the vehicle through movements. A power source is in communication with the drive motor, pivot motor, and control system. One of the vehicle movements is a rollover movement where the vehicle rolls between the first orientation and second orientation when the vehicle is at a rollover speed and in a rollover alignment. The rollover speed is further defined as a speed at which friction between a surface and one of the leading section wheel edges creates a frictional pivot point when in the rollover alignment; and the rollover alignment is further defined as an angled pivotal alignment between the two sections such that the vehicle's momentum at rollover speed and center of gravity cause the vehicle to roll over about a central vehicle axis and over the frictional pivot point. The vehicle may further include a capability for activating the programmed software instructions which may be configured to activate and control the drive motor to move the vehicle, and further configured to activate and control the pivot motor to rotate the pivot mechanism to steer the vehicle. Additionally, the software instructions may be configured to move the vehicle in a first direction such that the vehicle reaches rollover speed, and further configured to rotate the pivot mechanism to turn the lead section to the rollover alignment to create the frictional pivot point between the surface and the leading section wheel edge such that the vehicle rolls over between the first orientation and the second orientation, thereby completing the rollover movement.

In yet another illustrative embodiment there may be provided a toy vehicle having a first section and a second section with a pivot mechanism rotatably attaching the two sections such that the sections rotate substantially freely relative to one another. The first section is further defined as a leading section relative to the direction of vehicle movement and the second section is further defined as a trailing section relative to the direction of movement. Four wheels are rotatably attached to the vehicle including two drive wheels and two free wheels, each wheel including an edge and a height greater than the height of the two section chassis. The vehicle further includes a first orientation and a second orientation opposite the first orientation; a center of gravity defined by the vehicle; two drive motors, each in communication with one of the two drive wheels such that each drive motor is configured to drive forward and reverse rotation of the respective drive wheel; and a control system. The control system may have an integrated circuit in communication with the two drive motors and having programmed software instructions stored therein. The control system is configured to steer and direct the vehicle through movements including a rollover movement. A power source is in communication with the two drive motors and the control system. One of the movements is a rollover movement triggered when the vehicle is at a rollover speed further defined as a speed at which friction between a surface and one of the leading section wheel edges creates a frictional pivot point when the leading section rotates far enough to the left or right such that the vehicle's momentum and center of gravity cause the vehicle to roll over between the first orientation and the second orientation about a central vehicle axis and over the frictional pivot point. The vehicle may further include a capability for activating the programmed software instructions configured to activate and control the drive motors to move and steer the vehicle. Additionally, the software instructions may be configured to move the vehicle in a first direction such that the vehicle reaches rollover speed, and further configured to direct enough power to one of the drive motors to turn the first section to create the frictional pivot point between the surface and one of the leading wheel edges to roll the vehicle between the first orientation and the second orientation to complete the rollover movement.

The vehicle may also include a capability to align the two sections in a substantially linear relationship following an angled alignment between the sections. The capability to align the two sections in a substantially linear relationship may comprise the pivot mechanism including a pair of flanges extending from one of the sections and an extension extending from the other section. A first magnet is positioned on one of the flanges and a second magnet is positioned on the extension such that the polarities of the magnets attract one another. Wherein the magnets include a level of magnetism to suppress rotation of the pivot mechanism while assisting in returning the two sections to the substantially linear alignment following vehicle turning movements.

Numerous other advantages and features of the invention will become readily apparent from the following detailed description of the embodiments thereof, from the claims, and from the accompanying drawings.

BRIEF DESCRIPTION OF THE DRAWINGS

A fuller understanding of the foregoing may be had by reference to the accompanying drawings, wherein:

FIG. 5 *a* is a top view of the vehicle from FIG. 2*b* illustrating a section of the vehicle rotated counterclockwise at an initial step in executing the rollover movement;

FIG. 5 *c* is a perspective view of the vehicle from FIG. 2*b* illustrating a step in the rollover movement;

FIG. 5 *e* is a perspective view of the vehicle from FIG. 2*b* illustrating a step in the rollover movement;

DETAILED DESCRIPTION

Figure 1A:
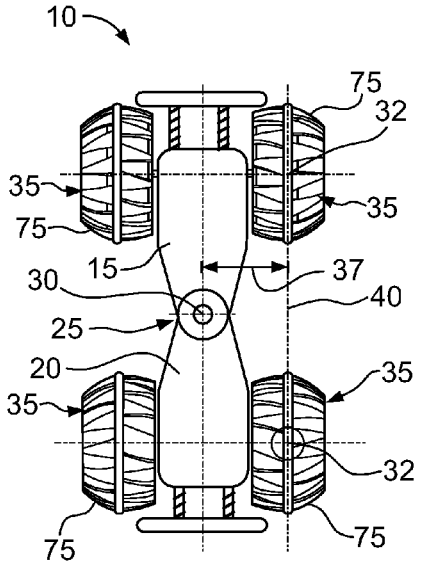
FIG. 1*a* is a top view of an illustrative embodiment of a vehicle.

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

While the invention is susceptible to embodiments in many different forms, there are shown in the drawings and will be described herein, in detail, the preferred embodiments of the present invention. It should be understood, however, that the present disclosure is to be considered an exemplification of the principles of the invention and is not intended to limit the spirit or scope of the invention, claims or the embodiments illustrated. This disclosure first discusses general principles along with vehicle components and dynamics relevant to the present invention and capabilities thereof. A disclosure of vehicles in accordance to illustrative embodiments follows.

A side rollover or barrel roll in various types of vehicles may result from a quick change in direction and a combination of enough momentum and high enough center of gravity. Typically vehicles that rollover may not roll back to their original orientation (roll back onto four wheels) due to various reasons including the location of the center of gravity, the design of a vehicle's body and/or lack of momentum. Aside from stunt shows or similar entertainment, side rollovers are typically not desirable in vehicles other than toys.

Conversely, in toy vehicles, stunts like side rollovers add play value and in particular rollovers on command may be desirable and further enhanced when combined with a vehicle chassis that facilitates wheel to surface contact in both a first orientation and a second orientation where the vehicle is upside down relative to the first orientation. Therefore, a toy vehicle having a center of gravity that can shift side to side while maintaining an equidistant vertical position relative to a surface in more than one orientation allows for controlled or predictable side rollovers.

Taking these principles into account and now referring to FIGS. 1*a* through 1*d*, in accordance to an illustrative embodiment, there is illustrated an exemplary vehicle 10 that may include a chassis with a first section 15, a second section 20 and a pivot mechanism 25 rotatably attaching the first section 15 and the second section 20. The vehicle 10 may achieve a controlled side rollover movement utilizing a combination of a shift in vehicle weight distribution (and thus shifting a vehicle center of gravity 30) via the two section chassis and the pivot mechanism 25, and a modified wheel shape to provide for a toy vehicle 10 rollover movement discussed herein. FIG. 1*a* illustrates the approximate positioning of vehicle's 10 center of gravity 30 when the first sections 15 and second section 20 are in line with one another. FIG. 1 *b* illustrates the approximate positioning of vehicle 10's center of gravity 30 when the first section 15 is rotated counterclockwise as during a left turn.

Figure 1B:
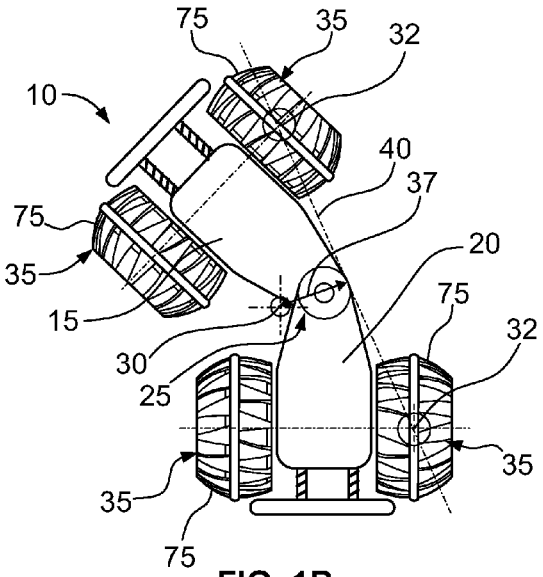
FIG. 1*b* is a top view of the vehicle from FIG. 1*a* where a first section of the vehicle's chassis is rotated counter clockwise.
Figure 1C:
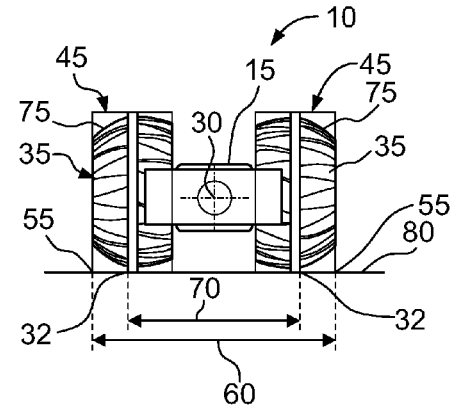
FIG. 1*c* is a front view of another illustrative embodiment of a vehicle illustrating a modified set of wheels in comparison to a typical wheel set.

While a typical, single section chassis has the potential to rollover, the two section chassis and pivot mechanism 25 of vehicle 10 facilitate the capability to shift the vehicle 10 center of gravity 30 during a turn or sharp change in direction to increase rollover capability. This may enable the vehicle 10 to roll over and about a central axis while in motion and at or above a rollover speed utilizing the pivot point or rollover point created at edge 32 of one of the wheels 35 while turning (further described below). The rollover speed is a speed great enough for the momentum and weight of the vehicle 10 to roll the vehicle 10 as the pivot mechanism 25 rotates the front section 15 to shift the weight distribution of the vehicle 10 which adjusts the positioning of the center of gravity 30 relative to the positioning of the wheels 35 on the outer side of a turn. FIGS. 1*a* and 1*b* further illustrate this shift with an approximate second position for the center of gravity 30 with dimension 37 and in comparison to a reference line 40 defined by surface contact points 32 on the wheels 35 on the outer side of a turn where the center of gravity 30 is positioned approximately in line with the pivot point at edge 32. The design of vehicle 10 also provides for an equal or substantially equal vertical distance from the center of gravity 30 relative to the surface 80 when in either a first orientation or second orientation.

Figure 1D:
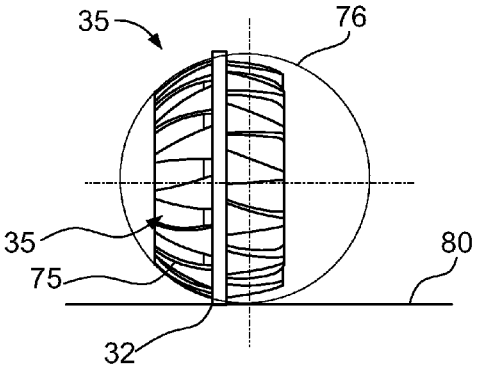
FIG. 1*d* is front view of a modified wheel profile compared to the geometry of a sphere or circle.
Figure 2A:
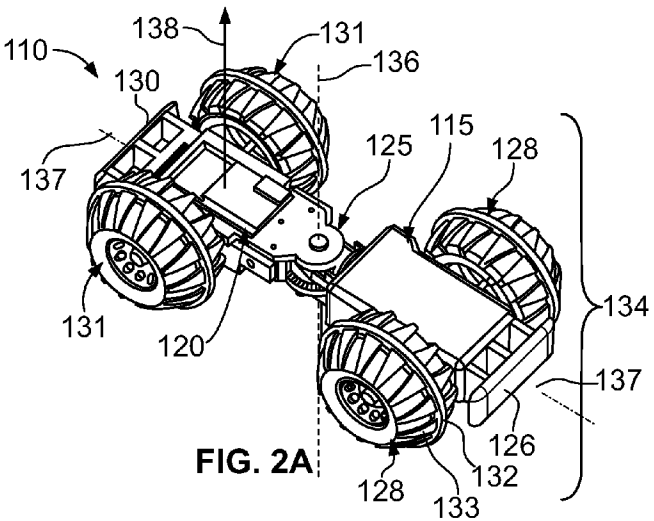
FIG. 2*a* is a front perspective view of another illustrative embodiment of a vehicle in a first orientation.
Figure 2B:
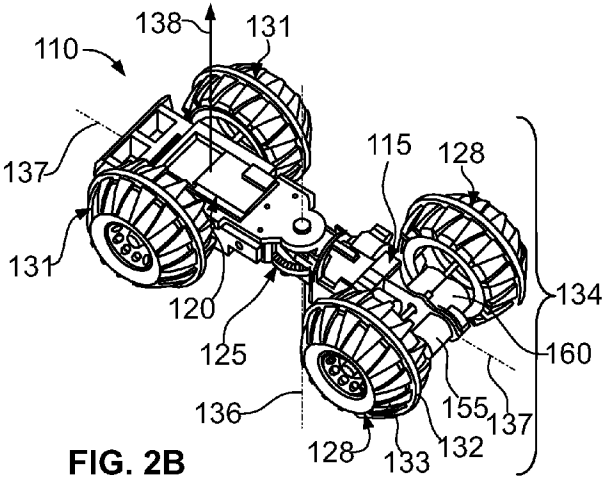
FIG. 2*b* is a front perspective view of the vehicle in FIG. 2*a* with a housing removed from a first section of the vehicle illustrating the internal components of the first section.
Figure 2C:
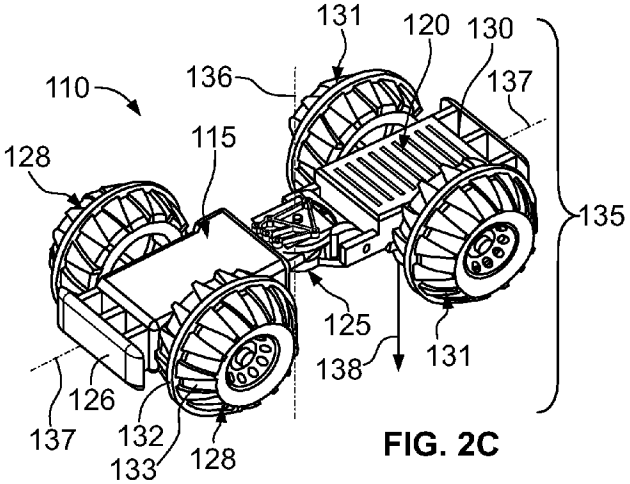
FIG. 2*c* is a front perspective view of the vehicle from FIG. 2*a* in a second orientation.
Figure 2D:
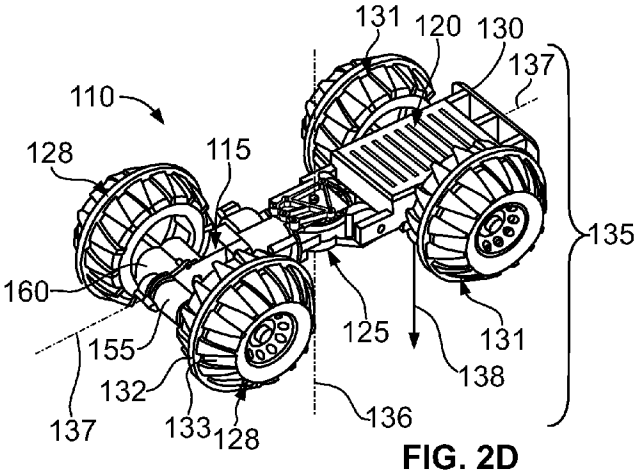
FIG. 2*d* is a front perspective view of the vehicle from FIG. 2*a* in a second orientation with a housing removed from a first section of the vehicle illustrating the internal components of the first section.

As mentioned above, an embodiment of the invention described herein also utilizes a modified wheel shape for wheels 35 to achieve a rollover movement. Continuing to refer to FIG. 1*c*, the differences between track width and profile of a typical wheel shape 45 and the wheels 35 are illustrated. Edges 55 on the typical wheel shape 45 define a first track width 60 there between. Edges 32 of a raised tread on the wheels 35 define a second track width 70 there between. During a turn or sharp change of direction and when moving at a high enough the speed, the edge 32 or edge 65 on the lead tire creates the pivot point or rollover point at which the vehicle's 10 momentum and weight will cause a side rollover about a central axis and over the pivot point. The second track width 70 increases rollover capability in comparison to the first track width 60 due to a shorter track width. A rounded tapered profile 75 on the modified wheel shape 50 further increase rollover capability due to additional clearance between the profile 75 and a surface 80. In FIG. 1*d*, the cross section or profile of the wheel is shown to share a similar geometry in comparison to a sphere 76 so as to further facilitate a smooth rollover movement. While a raised center tread to provide for edge 32 is illustrated, it is within the scope of the present invention to utilize an insert substantially flush to the wheel profile and made of frictional material such as rubber to achieve the rollover movement.

Referring now to FIGS. 2*a* through 2*d*, in accordance to another illustrative embodiment, there is illustrated an exemplary vehicle 110 that may include a chassis with a first section 115, a second section 120 and a pivot mechanism 125 rotatably attaching the first section 115 and the second section 120 at an axis 136. The first section 115 may include a first bumper 126 extending therefrom where portions of the first bumper 126 are positioned forward of a set of wheels 128 rotatably attached to the first section 115. The second section 120 may include a second bumper 130 extending therefrom where portions of the second bumper 130 are positioned rearward of a set of wheels 131 rotatably attached to the second section 120. The first bumper 126 and/or second bumper 130 may include a shock absorbing capability such as a spring (not shown). Further, the first bumper 126 and/or second bumper 130 may hingedly attach to the first section 115 and second section 120, respectively, to rotate upward or downward and may also include a capability to maintain a centered position such as a spring (not shown). While a variety of shapes and sizes may be used for the wheels 128 and wheels 131, preferred shapes and designs are illustrated herein to facilitate and enhance vehicle 110 performance (further described below). Further, each wheel may include a raised tread 132, a rounded tapered profile 133 and may be sized to provide vertical clearance of a height of the chassis and height of a vehicle housing (not shown).

The vehicle 110 may perform all of its movements without user control where the vehicle 110 responds to external factors, such as objects or terrain, to cause movements utilizing the components of the vehicle 110. Alternatively, the vehicle 110 may be controlled utilizing a variety of control systems including radio or remote control utilizing a transmitter/receiver pair and/or on-vehicle switches and/or sensors utilizing interactive preprogrammed content. The components of the vehicle 110 provide for a variety of movements and actions. One such example of a movement is a rollover movement where the vehicle 110 rolls about a central axis 137 while in motion (further described below). During the rollover movement the vehicle 110 may roll between a first orientation 134 and a second orientation 135 further defined to include the vehicle rolling over from the first orientation 134 to the second orientation 135 or the second orientation 135 to the first orientation 134. Perpendicular reference arrow 138 is included in the figures herein to assist in illustrating vehicle 110 positioning during movements. While the pivot mechanism 125 in this embodiment is motorized and rotates about axis 136, the invention may also utilize different pivot mechanism embodiments including a non-motorized pivot or a free pivot.

Continuing to refer to FIGS. 2*a* through 2*d*, forward and reverse movements of the vehicle may be directed by a drivetrain positioned in the first section 115. The drivetrain may include a drive motor 155 in electrical communication with a power source (not shown) which may be housed within the second section 120. The drivetrain may also be in mechanical communication with a gear train 160 (or gear box) to transfer power to the wheels 128 via an axle rotatably attached to the first section 115. As such, powering the drive motor 155 in a first or second direction drives the vehicle 110 in a forward or reverse direction.

Figure 3A:
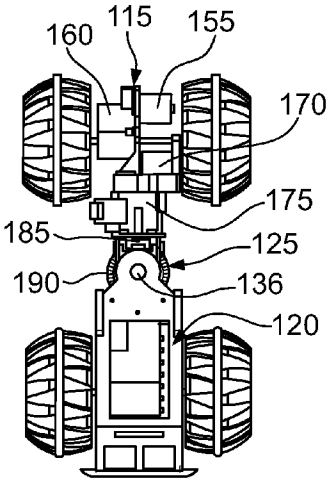
FIG. 3*a* is a top view of FIG. 2*b;*
Figure 3B:
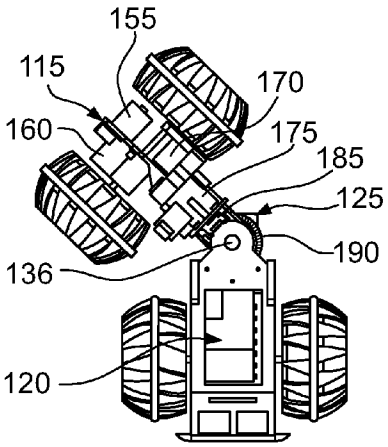
FIG. 3*b* is a top view of the vehicle from FIG. 2*b* illustrating a first section of the vehicle rotated counterclockwise.
Figure 3C:
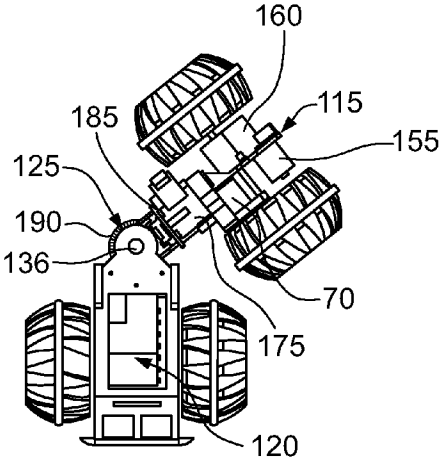
FIG. 3*c* is a top view of the vehicle from FIG. 2*b* illustrating a first section of the vehicle rotated clockwise.
Figure 3D:
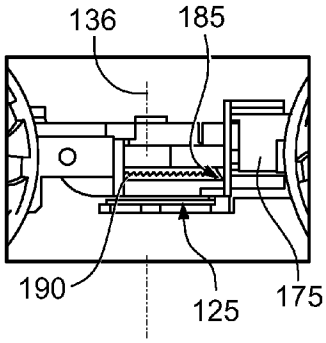
FIG. 3*d* is an enlarged side view of the vehicle from FIG. 2*b* illustrating an exemplary pivot mechanism.
Figure 3E:
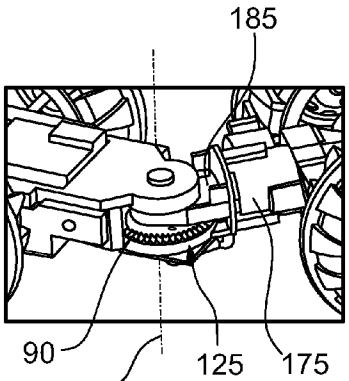
FIG. 3*e* is an enlarged perspective view of the vehicle from FIG. 2*b* illustrating an exemplary pivot mechanism rotated counterclockwise.
Figure 3F:
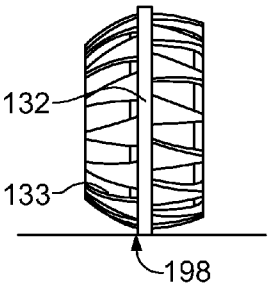
FIG. 3*f* is a front view of an exemplary wheel utilized in one embodiment of the present invention.

Now additionally referring to FIGS. 3*a* through 3*c*, the first section 115 is illustrated at a center position, a rotated counterclockwise position and a rotated clockwise position, respectively. Directional steering and a shifting of vehicle 110 weight distribution may be facilitated by a motorized capability to steer and direct vehicle 110 movements including the pivot mechanism 125 which rotatably attaches the first section 115 and second section 120 at the axis 136 as mentioned above. Referring now to FIGS. 3*d* and 3*e*, the motorized capability to steer and direct vehicle 110 movements may include a pivot motor 170 in mechanical communication with the pivot mechanism 125 which may include a gear train 175 (or gear box), a pinion bevel gear 185, a bevel gear 190 and a pivot axle (not shown) on axis 136. Powering the pivot motor 170 in a first direction or second direction rotates the pinion bevel gear 185 in rotatable mechanical communication therewith. The pinion bevel gear 185 is meshed with the bevel gear 190 to transfer rotation to the bevel gear 190 fixed to the second section 120. As such, powering the pivot motor 170 directs the pivot mechanism 125 to rotate clockwise or counterclockwise to direct steering as the drive motor 155 powers forward or reverse movement of the vehicle 110. FIG. 3*f* further illustrates a preferred design of the wheels 128 and wheels 131 with the raised tread 132, rounded tapered profile 133 and an edge 198.

Figure 4A:
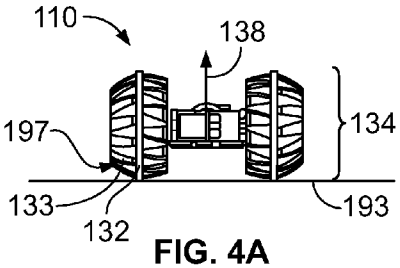
FIG. 4*a* is a front view of the vehicle from FIG. 2*b;*
Figure 4B:
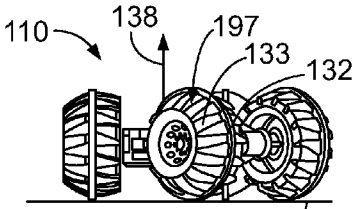
FIG. 4*b* is a front view of the vehicle from FIG. 2*b* illustrating a section of the vehicle rotated counterclockwise at an initial step in executing an exemplary rollover movement.
Figure 4C:
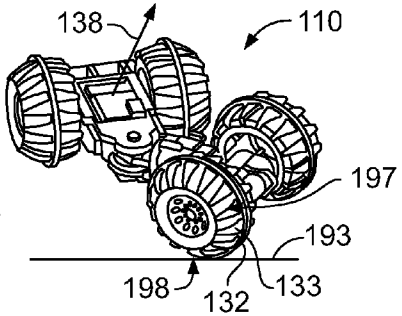
FIG. 4*c* is a perspective view of the vehicle from FIG. 2*b* illustrating a step in the rollover movement where an edge of a tread on a first right wheel "bites" and portions of the vehicle start to lift off of a surface.
Figure 4H:
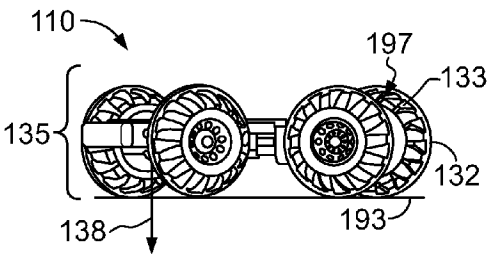
FIG. 4*h* is a side view of the vehicle in the second orientation from FIG. 2*c* illustrating the completion of the rollover movement.
Figure 4D:
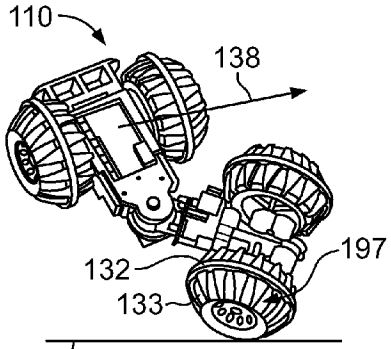
FIG. 4*d* is a perspective view of the vehicle from FIG. 2*b* illustrating a step in the rollover movement.
Figure 4G:
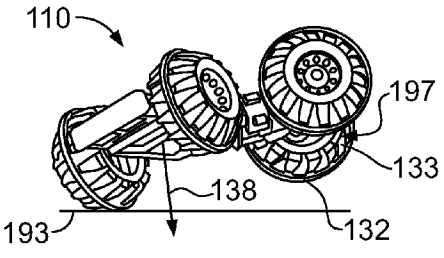
FIG. 4*g* is a perspective view of the vehicle from FIG. 2*b* illustrating a step in the rollover movement.
Figure 4E:
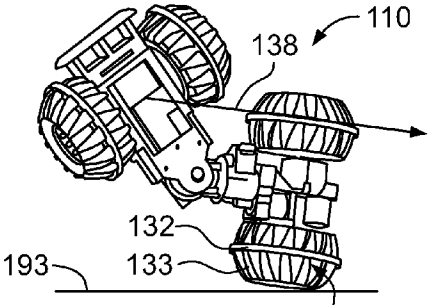
FIG. 4*e* is a perspective view of the vehicle from FIG. 2*b* illustrating a step in the rollover movement.
Figure 4F:
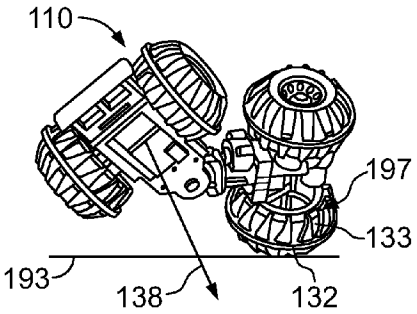
FIG. 4*f* is a perspective view of the vehicle from FIG. 2*b* illustrating a step in the rollover movement.
Figures 5A, 5B, 5C, 5D, 5E, 5F, 5G:
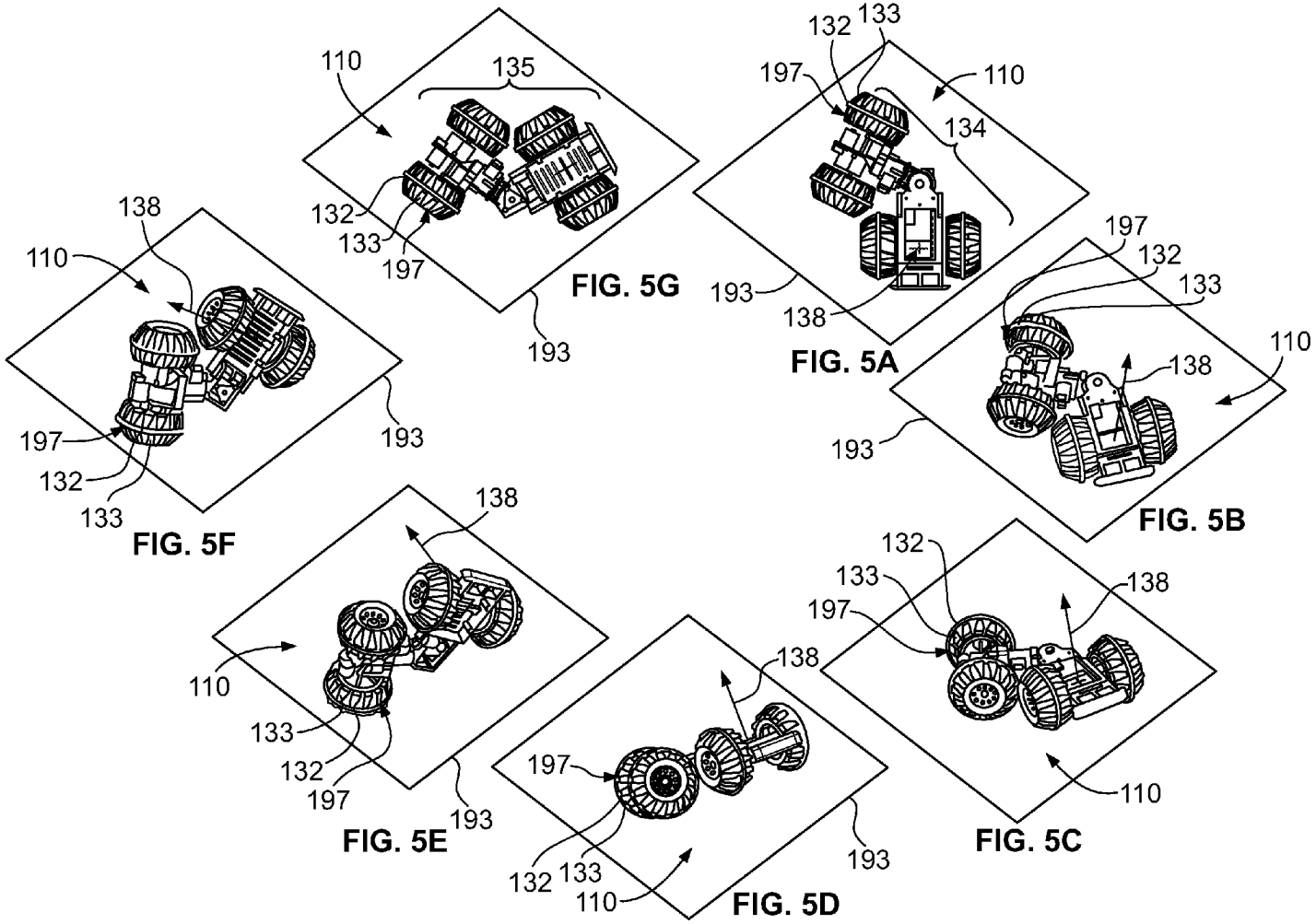
FIG. 5*b* is a perspective view of the vehicle from FIG. 2*b* illustrating a step in the rollover movement where an edge of a tread on a first right wheel "bites" and portions of the vehicle start to lift off of a surface.
FIG. 5*d* is a perspective view of the vehicle from FIG. 2*b* illustrating a step in the rollover movement.
FIG. 5*f* is a perspective view of the vehicle from FIG. 2*b* illustrating a step in the rollover movement.
FIG. 5*g* is a top view of the vehicle in the second orientation from FIG. 2*c* illustrating the completion of the rollover movement.

As mentioned above, the components included in the vehicle 110 facilitate movements including the rollover movement where the vehicle 110 rolls over and about axis 137 while in motion and at or above a rollover speed in accordance with user input. The rollover speed is a speed great enough to direct the center of gravity of the vehicle 110 to roll the vehicle 110 about axis 137 when a force (for example, the friction force created when the first section 115 turns to create a frictional pivot point at edge 198 of the raised tread 132 and a surface) acts against the direction of motion of the vehicle 110 to result in the rollover movement described herein. Rotating the pivot mechanism 125 shifts the weight distribution of the vehicle 110 which adjusts the center of gravity position relative to the wheels on the outer side of a turn during the initial stages of the rollover movement. Thus the center of gravity is positioned substantially in line with the pivot point at edge 198. When the vehicle 110 is moving at a speed below the rollover speed and the pivot mechanism 125 is activated, the vehicle 110 responds with left and right turns in accordance to rotation of the pivot mechanism 125. When the speed of the vehicle is at or above the rollover speed, activating the pivot mechanism 125 to turn the first section 115 far enough to create a pivot point at the edge 198 of the raised tread 132 relative to a surface (and thereby adjusting the positioning of the vehicle 110 center of gravity relative to the edge 198) will initiate the rollover movement illustrated in FIGS. 4*a* through 4*h* and further including perpendicular reference arrow 138. For example, FIG. 4*a* illustrates a front view of the vehicle 110 prior to activation of the pivot mechanism 125 on a surface 193. FIG. 4*b* illustrates a front view of the vehicle 110 where the pivot motor 170 directs the pivot mechanism 125 to rotate counterclockwise. When the vehicle 110 is at or above rollover speed and the pivot motor 170 rotates the pivot mechanism 125 counterclockwise (first section 115 turning to the left) far enough to create a pivot point at the edge 198 of the raised tread 132 as illustrated in FIG. 4*c*, a right wheel 197 of the wheels 128 starts to "bite" at the edge 198 of the raised tread 132 and portions of the vehicle 110 start to lift off of the surface 193. FIGS. 4*c* through 4*h* illustrate positions in the progression of the rollover movement as the momentum of the vehicle 110 continues to roll the vehicle 110 to the second orientation 135 as illustrated in FIG. 4*h*. FIG. 5*a* through FIG. 5*g* illustrate a top view of steps in the rollover movement.

Optionally, an orientation (described further below) sensor may determine vehicle 110 orientation relative to the surface to simplify user interface by converting user inputs to a user's first person perspective to direct vehicle 110 movements and execute the rollover movement in both the first orientation 134 and second orientation 135. Operation in multiple orientations including the first orientation 134 and second orientation 135 is further enabled by the wheels vertically clearing the vehicle 110 chassis and the vehicle housing as described above. It is also important to note that while the rollover movement is illustrated above with the first section 115 leading in a left turn while the vehicle 110 is moving in the first orientation 134, the vehicle 110 may execute the rollover movement while moving in other orientations and directions including starting in either the first orientation 134 or second orientation 135 and/or while moving in either a forward or reverse direction and/or while making left or right turns.

Figure 6:
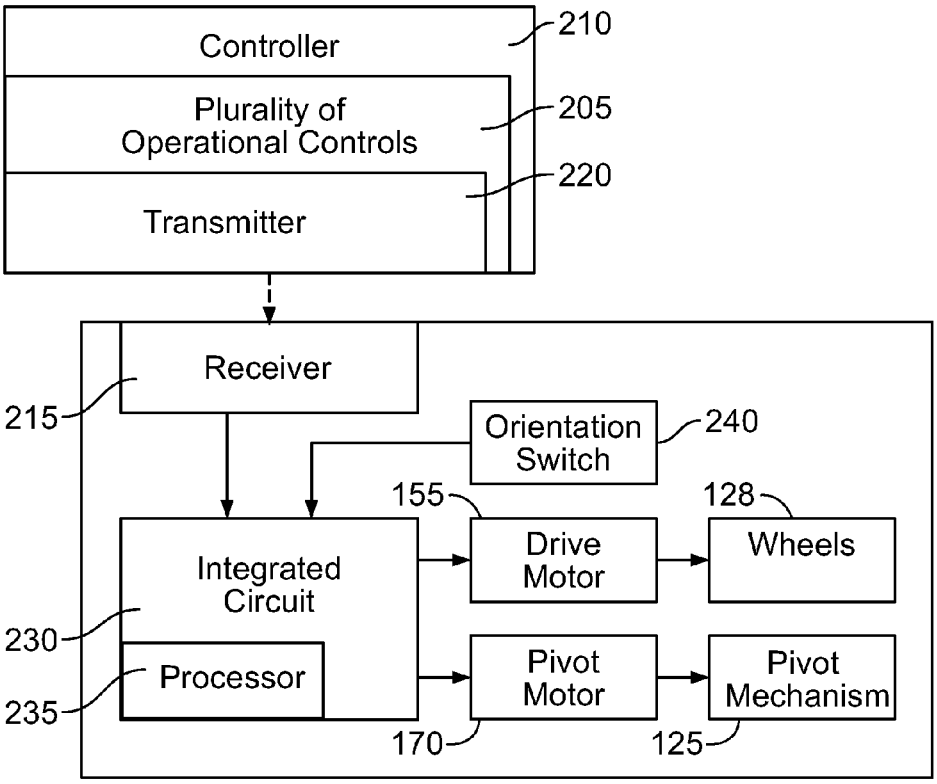
FIG. 6 is a block diagram of an illustrative vehicle.

Referring now to FIG. 6, there is shown a block diagram provided for an illustrative embodiment of the vehicle 110 utilizing the motorized pivot mechanism 125. When one of a plurality of operational controls 205 on a controller 210 is triggered in response to a user's input, a corresponding signal is sent to a receiver 215 via a transmitter 220 in electrical communication with the operational controls 205. The receiver 215 then sends a signal to an integrated circuit ("IC") 230 included in the vehicle 110. The IC 230 contains a processor 235 to direct control signals and receive input from an optionally included orientation sensor 240. The processor 235 accesses the signals in accordance to a user's input, then generates a control signal for the direction and power distribution to the drive motor 155 in mechanical communication with the wheels 128 and/or the pivot motor 170 in mechanical communication with the pivot mechanism 125. As such, the drive motor 150 powers the wheels 128 in a first or second direction and the pivot motor 170 rotates the pivot mechanism 125 in a clockwise or counterclockwise direction to steer the vehicle 110 while moving. Further, the processor 235 may receive signals from the orientation sensor 240 to determine whether the vehicle 110 is in the first orientation 134 or the second orientation 135. With this orientation determination, the processor 235 may convert user inputs such that a user does not have to compensate for the directional input differences between the first orientation 134 and second orientation 135. For example, an input directing the vehicle 110 to turn left in the first orientation 134 would direct the vehicle 110 to turn right in the second orientation 135 without the processor 235 converting control signals based on signals received from the orientation sensor 240.

As mentioned above, a pivot mechanism utilized in the present invention may have different embodiments utilizing various pivots including a motorized pivot, a non-motorized pivot or a free pivot. Another illustrative embodiment of the present invention utilizing a non-motorized pivot is now discussed.

Figure 7A:
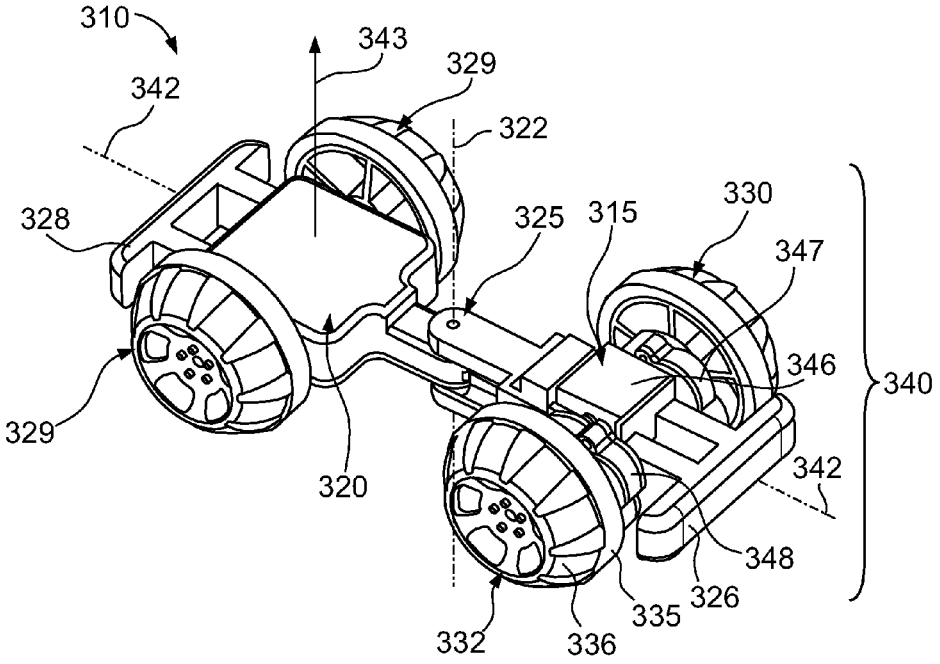
FIG. 7*a* is a front perspective view of another illustrative embodiment of a vehicle.
Figure 7B:
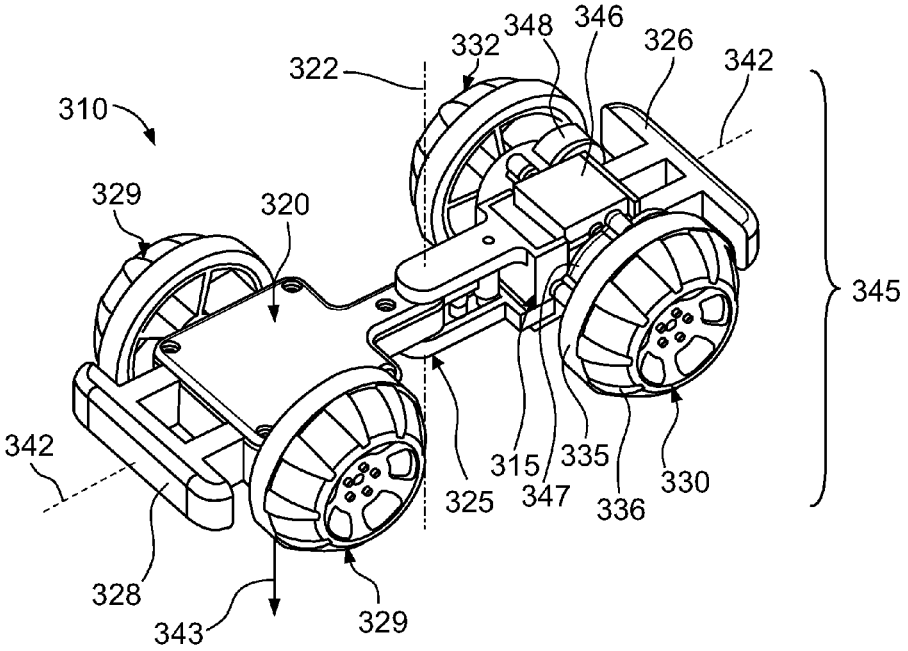
FIG. 7*b* is a front perspective view of the vehicle from FIG. 7*a* in a second orientation.

Referring now to FIGS. 7*a* and 7*b*, in accordance to another illustrative embodiment, there is illustrated an exemplary vehicle 310 that may include a chassis with a first section 315, a second section 320 and a non-motorized pivot mechanism 325 rotatably attaching the first section 315 and the second section 320 about an axis 322. The first section 315 may include a first bumper 326 extending therefrom where portions of the first bumper 326 are positioned forward of a first wheel 330 and a second wheel 332 rotatably attached to the first section 315. The second section 320 may include a second bumper 328 extending therefrom where portions of the second bumper 328 are positioned rearward of a set of wheels 329 rotatably attached to the second section 320. The first bumper 326 and/or second bumper 328 may include a shock absorbing capability such as a spring. Further, the first bumper 326 and/or second bumper 328 may hingedly attach (not shown) to the first section 315 and second section 320, respectively, such that the first bumper 326 and/or second bumper 328 pivot upward or downward and may also include a capability to maintain a centered position such as a spring. While a variety of shapes and sizes may be used for the first wheel 330, second wheel 332 and wheels 329, preferred sizes and designs are illustrated herein to facilitate and enhance vehicle 310 performances (described below). Further, each wheel includes may include a raised tread 335, a rounded tapered profile 336 and may be sized to provide vertical clearance of a height of the chassis and height of a vehicle housing (not shown).

The vehicle 310 may perform all of its movements without user control where the vehicle 310 responds to external factors, such as objects or terrain, to cause movements utilizing the components of the vehicle 310. Alternatively, the vehicle 310 may be controlled utilizing a variety of control systems including radio or remote control utilizing a transmitter/receiver pair and/or on-vehicle switches and/or sensors utilizing interactive preprogrammed content. The vehicle's 310 components may provide for a variety of movements and actions. One such example of a movement is a rollover movement where the vehicle 310 rolls about a central axis 342 while in motion (further described below). During the rollover movement the vehicle 310 may roll between a first orientation 340 and a second orientation 345 further defined to include the vehicle 310 rolling over from the first orientation 340 to the second orientation 345 or the second orientation 345 to the first orientation 340. Perpendicular reference arrow 343 is included in the figures herein to assist in illustrating vehicle 310 positioning.

Continuing to refer to FIGS. 7*a* and 7*b*, movement of the vehicle 310 may be directed by a drivetrain positioned in the first section 315. The drivetrain may include two motors 346 where each motor 346 independently drives the first wheel 330 or the second wheel 332. Each motor 346 is in electrical communication with a power source (not shown) which may be housed within the second section 320. A gear train 347 (or gear box) and gear train 348 in mechanical communication the motors 346 may transfer rotation to the first wheel 330 and/or the second wheel 332. As such, the first wheel 330 and second wheel 332 may be independently driven in a forward or reverse direction and in various combinations to facilitate steering and vehicle 310 movements, also described as tank-drive steering.

Figure 8A:
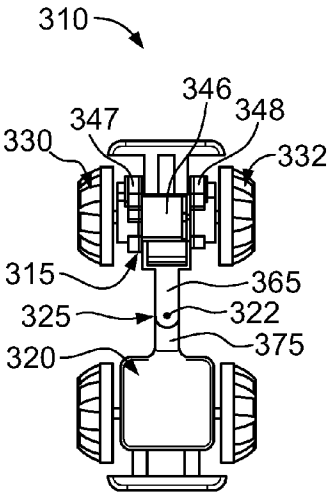
FIG. 8*a* is a top view of FIG. 7*a;*
Figure 8B:
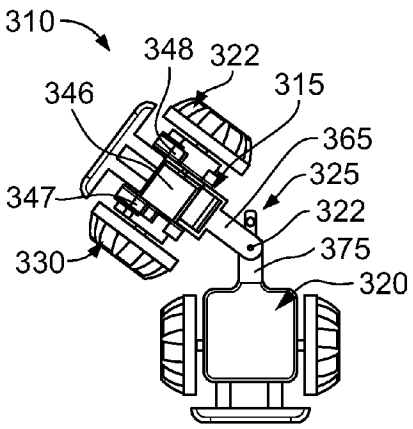
FIG. 8*b* is a top view of the vehicle from FIG. 7*a* illustrating a first section of the vehicle rotated counterclockwise.
Figure 8C:
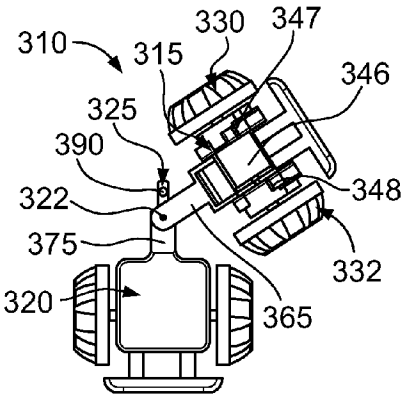
FIG. 8*c* is a top view of the vehicle from FIG. 7*a* illustrating the first section of the vehicle rotated clockwise.
Figure 8D:
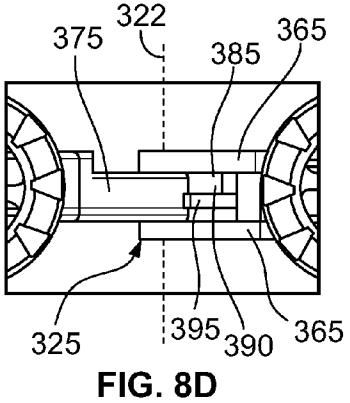
FIG. 8*d* is an enlarged side view of the vehicle from FIG. 7*a* illustrating an exemplary pivot mechanism.
Figure 8E:
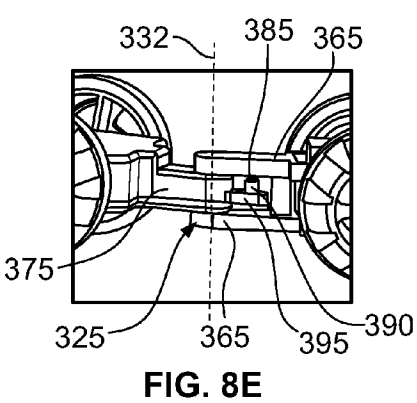
FIG. 8*e* is an enlarged perspective view of the vehicle from FIG. 7*a* illustrating an exemplary pivot mechanism rotated counterclockwise.
Figure 8F:
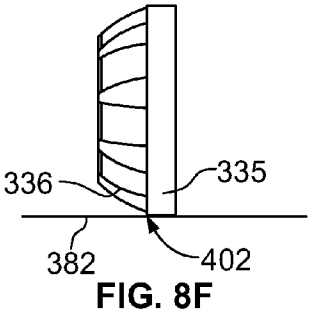
FIG. 8*f* is a front view of an exemplary wheel utilized in one embodiment of the present invention.

Now additionally referring to FIGS. 8*a* through 8*c*, the first section 315 is illustrated at a center position, a rotated counterclockwise position and a rotated clockwise position, respectively. Directional steering and a shifting of vehicle 310 weight distribution are facilitated by a capability to steer and direct vehicle 310 movements including the motorized first wheel 330, the motorized second wheel 332 and the pivot mechanism 325 to assist in facilitating vehicle 310 movements such as the rollover movement described further below. Now additionally referring to FIGS. 8*d* and 8*e*, the pivot mechanism 325 rotatably may attach the first section 315 and second section 320 at the axis 322. The first section 315 may include a pair of flanges 365 extending therefrom and in the direction of the second section 320. The second section 320 may include an extension 375 to assist in facilitating the rotatable attachment of the first section 315 and second section 320 on the axis 322. As such, when the drivetrain directs vehicle movements, the pivot mechanism may enable a rotational or pivoting relationship between the first section 315 and the second section 320.

Additionally, the pivot mechanism 325 may optionally utilize a capability to assist with vehicle control, for example the utilization of magnetism. A first magnet 385 may be positioned on one of the flanges 365 and a second magnet 390 may be positioned on a flange 395 extending from the extension 375 such that the polarities attract one another. Appropriate magnet strengths may be used to provide an appropriate level of magnetism to assist in maintaining a consistent and linear relationship between the first section 315 and second section 320 while moving which is more consistent than a free pivot without magnetism provides. Further, the level of magnetism is less than that of the motor forces directing steering (described below) such that the magnetism does not prevent turning altogether but rather facilitates suppressed pivoting of the pivot mechanism 325 when user inputs direct the vehicle 310 to turn. FIG Sf further illustrates a preferred design of the wheels 329, wheel 330 and wheel 332 with the raised tread 335, rounded tapered profile 336 and an edge 402.

Figure 9B:
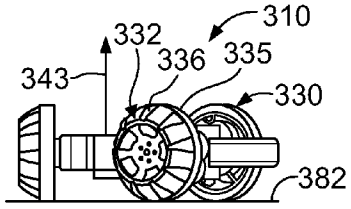
FIG. 9*b* is a front view of the vehicle from FIG. 7*a* illustrating a first section rotating counterclockwise at an initial step in executing an exemplary rollover movement.
Figure 9C:
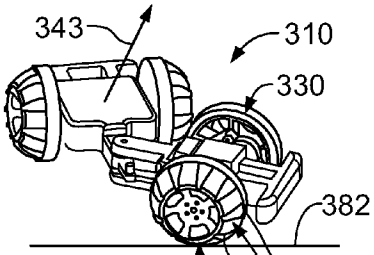
FIG. 9*c* is a perspective view of the vehicle from FIG. 7*a* illustrating an exemplary step in the rollover movement where an edge of a tread of a wheel "bites" and portions of the vehicle start to lift off of a surface.
Figure 9D:
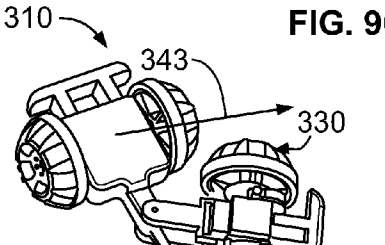
FIG. 9*d* is a perspective view of the vehicle from FIG. 7*a* illustrating a step in the rollover movement.
Figure 9A:
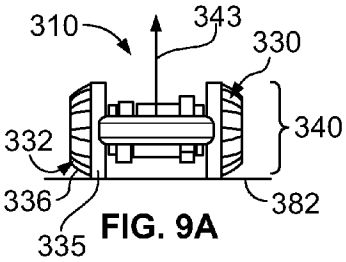
FIG. 9*a* is a front view of the vehicle from FIG. 7*a;*
Figure 9E:
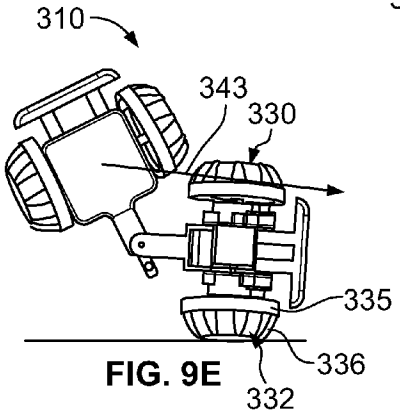
FIG. 9*e* is a perspective view of the vehicle from FIG. 7*a* illustrating a step in the rollover movement.
Figure 9H:
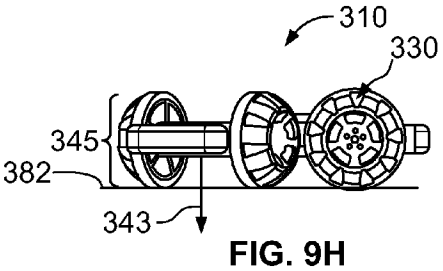
FIG. 9*h* is a side view of the vehicle in the second orientation from FIG. 7*b* illustrating completion of the rollover movement.
Figure 9G:
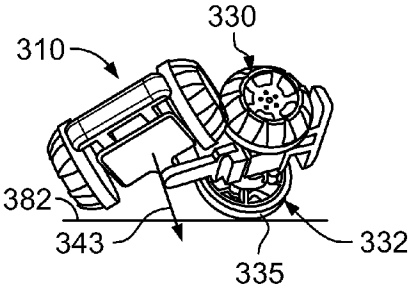
FIG. 9*g* is a perspective view of the vehicle from FIG. 7*a* illustrating a step in the rollover movement.
Figure 9F:
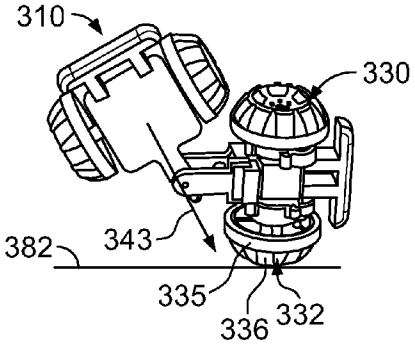
FIG. 9*f* is a perspective view of the vehicle from FIG. 7*a* illustrating a step in the rollover movement.
Figure 10A:
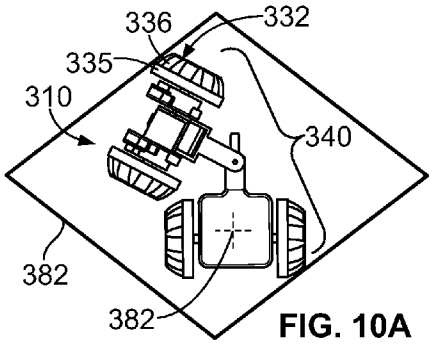
FIG. 10*a* is a top view of the vehicle from FIG. 7*a* illustrating an exemplary section of the vehicle rotated counterclockwise at an initial step in executing the rollover movement.
Figure 10B:
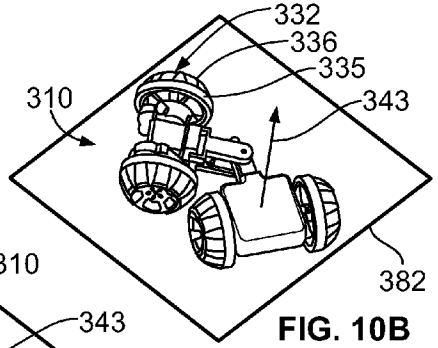
FIG. 10*b* is a perspective view of the vehicle from FIG. 7*a* illustrating a step in the rollover movement where an edge of a tread on a first right wheel "bites" and portions of the vehicle start to lift off of a surface.
Figure 10C:
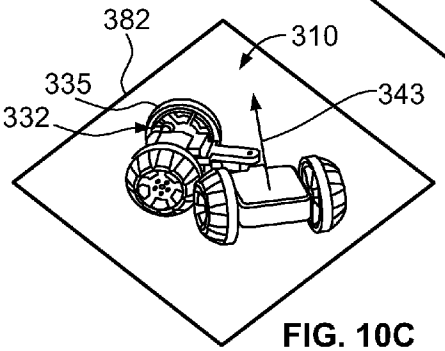
FIG. 10*c* is a perspective view of the vehicle from FIG. 7*a* illustrating a step in the rollover movement.
Figure 10G:
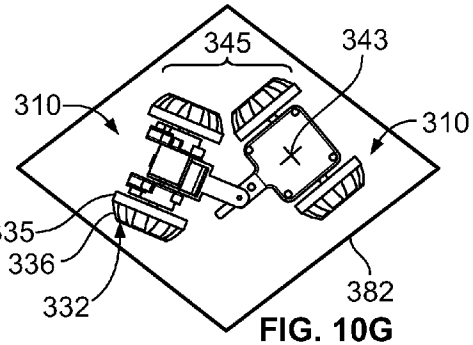
FIG. 10*g* is a top view of the vehicle in the second orientation from FIG. 7*b* illustrating the completion of the rollover movement.
Figure 10D:
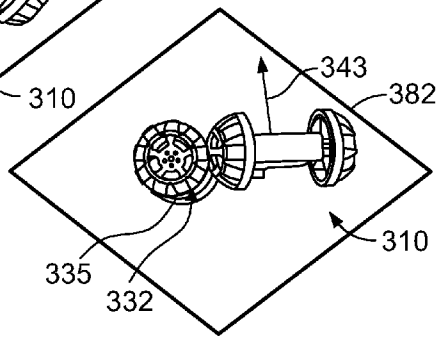
FIG. 10*d* is a perspective view of the vehicle from FIG. 7*a* illustrating a step in the rollover movement.
Figure 10F:
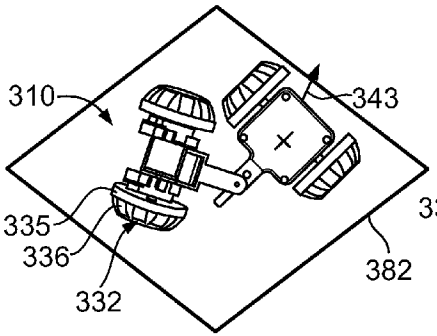
FIG. 10*f* is a perspective view of the vehicle from FIG. 7*a* illustrating a step in the rollover movement.
Figure 10E:
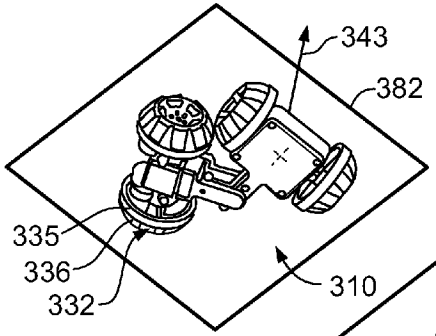
FIG. 10*e* is a perspective view of the vehicle from FIG. 7*a* illustrating a step in the rollover movement.

As mentioned above, the components included in the vehicle 310 may facilitate movements including the rollover movement where the vehicle 310 rolls about axis 342 while in motion and at or above the rollover speed in accordance with user input. Adjusting the power distribution to the motors 346 while the vehicle is in motion may facilitate steering as rotation of the first wheel 330 and/or second wheel 332 increases or decreases in accordance thereto. In this embodiment, the rollover speed is a speed great enough to direct the center of gravity of the vehicle 310 to roll the vehicle 310 about axis 342 when a force (for example, the friction force created when the first section 315 turns to create a pivot point at edge 402 of the raised tread 335 and a surface 382) acts against the direction of motion of the vehicle 310 to result in the rollover movement described herein. Powering the first wheel 330 or second wheel 332 enough to overcome the level of magnetism in the pivot mechanism 325 may direct a turn and shift the weight distribution of the vehicle 310 which adjusts the positioning of the center of gravity relative to the positioning of the wheels on the outer side of a turn during the initial stages of the rollover movement. Thus, the center of gravity is positioned substantially in line with the pivot point at edge 402. As described above, when vehicle speed is below the rollover speed, the vehicle 310 may respond with left and right turns in accordance to the power distribution to each motor 346. When the vehicle speed is at or above the rollover speed, adjusting power to the first wheel 330 and/or second wheel 332 may initiate the rollover movement when the first section 315 turns enough to create a pivot point at the edge 402 of the raised tread 335 relative to a surface (and thereby adjusting the positioning of the vehicle 310 center of gravity relative to the edge 402) will initiate the rollover movement illustrated in FIGS. 9*a* through 9*h* and further including the perpendicular reference arrow 343. For example, FIG. 9*a* illustrates a front view of the vehicle 310 in the first orientation 340 on a surface 382 prior to adjusting the power distribution to one of the motors 346 to direct a turn. FIG. 9*b* illustrates a front view of the vehicle 310 where power distributed to the second wheel 332 is greater than power distributed to the first wheel 330. When the vehicle 310 is at or above rollover speed and the power distributed to the second wheel 332 is greater than power to the first wheel 330 (first section 315 turning counterclockwise) as illustrated in FIG. 9*c*, the first wheel 332 starts to "bite" at the edge 402 of the raised tread 335 and portions of the vehicle 310 start to lift off of the surface 382. FIGS. 9*c* through 9*h* illustrate positions in the progression of the rollover movement as the momentum of the vehicle 310 continues to roll the vehicle 310 to the second orientation 345 as illustrated in FIG. 9*h*. FIGS. 10*a* through 10*g* illustrate a top view of the rollover movement.

Figure 11:
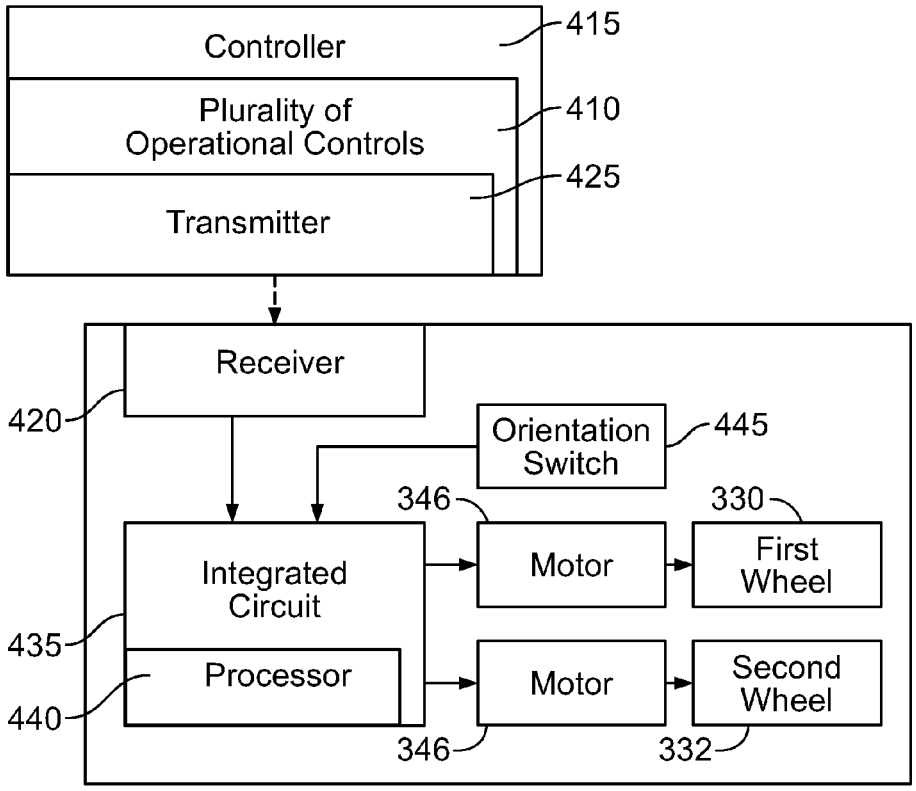
FIG. 11 is a block diagram of an illustrative vehicle.

Optionally, an orientation sensor (described further below) determines vehicle 310 orientation relative to the surface to simplify user interface and control by converting user inputs to a user's first person perspective to direct vehicle 310 movements and execute the rollover movement in both the first orientation 340 and second orientation 345 and while moving in both directions. Operation in multiple orientations including the first orientation 340 and second orientation 345 is further enabled by the wheels vertically clearing the vehicle 310 chassis and the vehicle housing as described above. It is also important to note that while the rollover movement is illustrated above with the first section 315 leading in a left turn while the vehicle 310 is moving in the first orientation 340, the vehicle 310 may execute the rollover movement while moving in other orientations and directions including starting in either the first orientation 340 or second orientation 345 and/or while moving in either a forward or reverse direction and/or while making left or right turns. Referring now to FIG. 11, there is shown a block diagram provided for an embodiment of the vehicle 310 utilizing the pivot mechanism 325. When one of a plurality of operation controls 410 on a controller 415 is triggered in response to a user's input, a corresponding signal is sent to a receiver 420 via a transmitter 425 in electrical communication with the operational controls 410. The receiver 420 then sends a signal to an integrated circuit ("IC") 435 included in the vehicle 310. The IC 435 contains a processor 440 to direct control signals and receive input from an optionally included orientation sensor 445. The processor 435 accesses the signals in accordance to a user's input, then generates a control signal(s) for the direction and power distribution to each of the motors 346 in communication with the respective first wheel 330 or second wheel 332. As such, the motors 346 power the first wheel 330 and second wheel 332 in either a first or second direction and at appropriate power levels in accordance with a user's input to steer the vehicle 310. Further, the processor 440 may receive signals from the orientation sensor 445 to determine whether the vehicle 310 is in the first orientation 340 or the second orientation 345. With this orientation determination, the processor may convert user inputs such that a user does not have to compensate for the directional input differences between the first orientation 340 and the second orientation 345. For example, an input directing the vehicle 310 to turn left in the first orientation 340 would direct the vehicle 310 to turn right in the second orientation 345 without the processor 440 converting control signals based on input signals received from the orientation sensor 445.

Further, in an illustrative embodiment, an exemplary vehicle may include a capability to direct steering via a pivot mechanism and a two section chassis.

Additionally, in another illustrative embodiment, an exemplary vehicle includes a capability to direct a controlled rollover movement utilizing a capability to direct steering and a pivot mechanism and two section chassis.

In yet another illustrative embodiment, an exemplary vehicle also may include a capability to steer the vehicle with preprogrammed movements utilizing switches and/or sensors included on the vehicle.

In yet another illustrative embodiment, an exemplary vehicle may include a capability to trigger a rollover movement utilizing a capability to steer the vehicle utilizing switches and/or sensors included on the vehicle.

From the foregoing and as mentioned above, it will be observed that numerous variations and modifications may be effected without departing from the spirit and scope of the novel concept of the invention. It is to be understood that no limitation with respect to the specific methods and apparatus illustrated herein is intended or inferred.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A toy vehicle comprising:

a two-section chassis including a first section having a first flange and a second section having a an extension;

a pivot mechanism rotatably attaching the first flange and the extension about an axis such that the first section and the second section rotate substantially freely about the axis and relative to one another, the first section further defined as a leading section relative to a direction of vehicle movement, the second section further defined as a trailing section relative to the direction of vehicle movement;

a first magnet positioned on the first flange and a second magnet positioned on the extension, the first and second magnets being configured such that polarities of the first and second magnets attract one another wherein the first magnet and the second magnet include a level of magnetism to suppress rotation of the pivot mechanism while assisting in returning the two sections to a substantially linear alignment following an angled alignment between the two sections;

four wheels rotatably attached to the vehicle including two drive wheels and two free wheels, each wheel including an edge and a height greater than a height of the two-section chassis;

a first orientation and a second orientation, the second orientation further defined as a vehicle orientation opposite the first orientation;

a center of gravity defined by the vehicle;

two drive motors, each in communication with one of the two drive wheels such that each drive motor is configured to drive forward and reverse rotation of the respective drive wheel;

a control system with an integrated circuit in communication with the two drive motors, the control system having programmed software instructions stored therein and configured to steer and direct the vehicle through a plurality of movements including a rollover movement;

a power source in communication with the two drive motors and the control system;

a rollover speed further defined as a speed at which friction between a surface and one of the wheel edges of one of the four wheels rotatably attached to the leading section creates a frictional pivot point when the first section rotates far enough left or right and where vehicle momentum and the center of gravity initiates the rollover movement in which the vehicle rolls over between the first orientation and the second orientation about a central vehicle axis and over the frictional pivot point; and a capability for activating the programmed software instructions, said programmed software instructions being configured to activate and control the drive motors to move and steer the vehicle, wherein the rollover movement is further defined by the software instructions:

(i) being configured to move the vehicle in a first direction such that the vehicle reaches rollover speed, and (ii) being further configured to direct enough power to one of the drive motors to turn the leading section to create the frictional pivot point between the surface and leading section wheel edge such that the vehicle rolls over between the first orientation and the second orientation, thereby completing the rollover movement.

2. The toy vehicle of claim 1, wherein the pivot mechanism further includes:

a second flange extending from the first section such that the second flange is spaced from one of the first flange to permit disposal of the extension from the second section between the first and second flanges.

3. The toy vehicle of claim 1 further comprising:

at least one sensor in communication with the integrated circuit such that triggering the sensor directs the software instructions to initiate the rollover movement.

4. The toy vehicle of claim 1 further comprising:

a receiver in communication with the integrated circuit; and a remote control unit with a transmitter to send commands to the receiver to direct a speed of the two drive motors in response to the commands, wherein a user initiates the rollover movement by sending commands to:

(i) move the vehicle in a first direction such that the vehicle reaches rollover speed, and (ii) direct enough power to one of the drive motors to turn the leading section far enough to create the frictional pivot point between the surface and leading section wheel edge such that the vehicle rolls over between the first orientation and the second orientation, thereby completing the rollover movement.

5. The toy vehicle of claim 4 further comprising:

an orientation sensor in communication with the control system to identify vehicle orientation such that the control system may convert user initiated commands in accordance with the first orientation and second orientation and in accordance to a user's first person perspective.

6. The toy vehicle of claim 1, wherein each wheel edge is further included on a raised tread, and each wheel further includes a round tapered profile on an outer portion of the wheel relative to the vehicle.

7. The toy vehicle of claim 1, wherein the vehicle includes a bumper extending from one of the sections and past one of the sets of wheels.

8. A toy vehicle comprising:

a two-section chassis including a first section having a first flange and a second section having a an extension;

a pivot mechanism rotatably attaching the first flange and the extension about an axis such that the first section and the second section rotate substantially freely about the axis and relative to one another, the first section further defined as a leading section relative to a direction of vehicle movement, the second section further defined as a trailing section relative to the direction of vehicle movement;

a first magnet positioned on the first flange and a second magnet positioned on the extension, the first and second magnets being configured such that polarities of the first and second magnets attract one another, wherein the first magnet and the second magnet include a level of magnetism to suppress rotation of the pivot mechanism while assisting in returning the two sections to a substantially linear alignment following an angled alignment between the two sections;

a pair of drive wheels rotatably mounted to the first section, each of the pair of drive wheels including a first wheel edge and a first height greater than a height of the two-section chassis;

a pair of free wheels mounted to the second section, each of the pair of free wheels including a second wheel edge and a second height greater than the height of the two-section chassis;

a pair of drive motors each in communication with one of the pair of drive wheels to drive forward and reverse rotation;

a power source in communication with each of the pair of drive motors; and a control system in communication with the power source and programmed to selectively apply power to each of the pair of drive motors, wherein the control system is further programmed to operate each of the pair of drive motors at a rollover speed in which friction between a surface and one of the wheel edges creates a frictional pivot point when one of the first section and the second section pivots far enough left or right such that the a momentum of the toy vehicle and a toy vehicle center of gravity causes the two-section chassis to roll over between the first orientation and the second orientation about a central toy vehicle axis and over the frictional pivot point.

9. The toy vehicle of claim 8, wherein the control system is further programmed to power the pair of drive motors to move the toy vehicle in the forward or reverse direction at the rollover speed and to distribute power to the pair of drive motors to turn a leading section of the first section and the second section to create the frictional pivot point such that the toy vehicle rolls over between the first orientation and the second orientation.

10. The toy vehicle of claim 8, wherein the control system is further programmed to selectively distribute power to each of the pair of drive motors to align the first section and the second section in a substantially linear relationship following an angled alignment between the first section and the second section.

11. The toy vehicle of claim 8 further comprising:

a receiver in communication with the control system; and a remote control unit with a transmitter to send command signals to the receiver to direct operation of the control system.

12. The toy vehicle of claim 11 further comprising:

an orientation sensor in communication with the control system to identify whether the toy vehicle is oriented in the first orientation or the second orientation to convert the command signals to a user's perspective.

13. The toy vehicle of claim 1, wherein each of the first wheel edges and the second wheel edges is located upon a raised tread, and wherein each wheel of the pair of drive wheels and each wheel of the pair of free wheels defines a tapered round profile on an outer portion of the wheel.

14. The toy vehicle of claim 1 further comprising:

a bumper extending from one of the first section and the second section and past a respective pair of wheels.

* * * * *